US011800606B2

(12) United States Patent
Sasagawa et al.

(10) Patent No.: US 11,800,606 B2
(45) Date of Patent: Oct. 24, 2023

(54) INDUCTION HEATING COOKER

(71) Applicant: Samsung Electronics Co., Ltd., Suwon-si (KR)

(72) Inventors: Masashi Sasagawa, Yokohama (JP); Masayuki Ohtawara, Yokohama (JP); Nobuharu Nishikoori, Yokohama (JP); Taro Yoshida, Yokohama (JP); Tomoyuki Kanagawa, Yokohama (JP); Yutaka Yagi, Yokohama (JP); Masaki Ono, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 274 days.

(21) Appl. No.: 17/103,193

(22) Filed: Nov. 24, 2020

(65) Prior Publication Data

US 2021/0168912 A1 Jun. 3, 2021

(30) Foreign Application Priority Data

Nov. 29, 2019 (JP) ..... 2019-216178
Aug. 13, 2020 (KR) ..... 10-2020-0101623

(51) Int. Cl.
*H05B 6/12* (2006.01)
*F24C 7/08* (2006.01)
(Continued)

(52) U.S. Cl.
CPC ..... *H05B 6/1263* (2013.01); *F24C 7/083* (2013.01); *F24C 15/101* (2013.01); *H05B 6/062* (2013.01); *H05B 2213/07* (2013.01)

(58) Field of Classification Search
CPC ..... F24C 15/101; F24C 7/083; H05B 6/1263; H05B 2213/07; H05B 6/062; H05B 2206/022
See application file for complete search history.

(56) References Cited

U.S. PATENT DOCUMENTS 9,006,622 B2 4/2015 Beverly et al.
2012/0152933 A1* 6/2012 Matsui ..... H05B 6/1263 219/623

FOREIGN PATENT DOCUMENTS

EP 2 549 831 A1 1/2013
JP 2004-039263 A 2/2004
(Continued)

OTHER PUBLICATIONS

International Search Report dated Apr. 7, 2021, issued in International Patent Application No. PCT/KR2020/016677.
(Continued)

*Primary Examiner* — Dana Ross
*Assistant Examiner* — Kuangyue Chen
(74) *Attorney, Agent, or Firm* — Jefferson IP Law, LLP

(57) ABSTRACT

An induction heating cooker for achieving high output of power and small thickness is provided. The induction heating cooker includes a main body provided at an upper side with a top plate, a heating coil to induction-heat a heating object loaded on the top plat, and a blower device configured to draw external air into the main body and blow the air into the heating coil. The heating coil and the blower device are accommodated in the main body. The main body is provided therein with a first flow path allowing air blown by the blowing device to be supplied toward the heating coil from an outer periphery side and a second flow path allowing air blown by the blowing device to be supplied toward the heating coil from a lower side.

14 Claims, 5 Drawing Sheets

(51) Int. Cl.
*F24C 15/10* (2006.01)
*H05B 6/06* (2006.01)

(56) References Cited

FOREIGN PATENT DOCUMENTS

| | | | | | |
|---|---|---|---|---|---|
| JP | 2004039263 | A | * | 2/2004 | |
| JP | 2010-062090 | A | | 3/2010 | |
| JP | 2010-287324 | A | | 12/2010 | |
| JP | 2011-253805 | A | | 12/2011 | |
| JP | 2016-048704 | A | | 4/2016 | |
| JP | 6351797 | B2 | | 7/2018 | |
| JP | 2019-046726 | A | | 3/2019 | |
| JP | 2019-153491 | A | | 9/2019 | |
| KR | 10-1772189 | B1 | | 8/2017 | |
| KR | 10-2018-0072628 | A | | 6/2018 | |
| KR | 20180072628 | | * | 6/2018 | ..... F24C 11/00 |

OTHER PUBLICATIONS

European Search Report dated Sep. 19, 2022; European Appln. No. 20893003.2-1202 / 4018782 PCT/KR2020016677.

* cited by examiner

INDUCTION HEATING COOKER

CROSS-REFERENCE TO RELATED APPLICATION

This application is based on and claims priority under 35 U.S.C. § 119 of a Japanese patent application number 2019-216178, filed on Nov. 29, 2019 in the Japanese Patent Office and of a Korean patent application number 10-2020-0101623, filed on Aug. 13, 2020 in the Korean Intellectual Property Office, the disclosure of each of which is incorporated by reference herein in its entirety.

BACKGROUND

1. Field

The disclosure relates to an induction heating cooker. More particularly, the disclosure relates to an induction heating cooker for achieving high output of power and small thickness.

2. Description of Related Art

An induction heating cooker allows a high-frequency current to pass through a heating coil to generate a high-frequency magnetic flux, which is provided to pass through a heating object, such as a frying pan or a pot, loaded on a top plate, and heat the heating object using electromagnetic induction. In such an induction heating (IH), a high-frequency magnetic flux passing through a heating object induces an eddy current to the heating object, and the heating object is heated by heat generated by the electrical resistance thereof.

In an induction heating cooker, when induction heating heats a heating object, the heating coil becomes hot due to a phenomenon (referred to as a skin effect or a proximity effect), such as causing energy loss. Accordingly, in order to cool the heating coil, the induction heating cooker is provided with a blower device that introduces external air into a main body and blows the introduced air to the heating coil. An example of the induction heating cooker is disclosed in Japanese Patent Application Publication Number JP2019-046726 A.

The above information is presented as background information only to assist with an understanding of the disclosure. No determination has been made, and no assertion is made, as to whether any of the above might be applicable as prior art with regard to the disclosure.

SUMMARY

In order to improve the heating performance for the heating object, the above described induction heating cooker needs to achieve high output of power. In order to achieve high output of power in the induction heating cooker, current applied to the heating coil needs to have high frequency or high current, which results in heat generation increasing by the induction heating of the heating coil. Therefore, in the conventional induction heating cooker, a large-sized air blower device is used to improve the cooling function of the heating coil.

In particular, in the case of an induction heating cooker capable of coping with all types of metals by induction-heating even non-magnetic and low-resistance metals, such as aluminum and copper, since the frequency of current applied to the heating coil is high, a large-sized blower device is required to cool the heating coil. However, when a large-sized blower device is used, a relatively large space is required in the main body to accommodate the blower device, which causes the size of the induction heating cooker to be increased.

Aspects of the disclosure are to address at least the above-mentioned problems and/or disadvantages and to provide at least the advantages described below. Accordingly, an aspect of the disclosure to provide an induction heating cooker capable of increasing output of power of the induction heating cooker with a reduced size.

In order to achieve the above object, in the technique of the disclosure, air is blown from a blower device to the heating coil in two directions.

Additional aspects will be set forth in part in the description which follows and, in part, will be apparent from the description, or may be learned by practice of the presented embodiments.

In accordance with an aspect of the disclosure, an induction heating cooker is provided. The induction heating cooker includes a main body provided at an upper side with a top plate, a heating coil to induction-heat a heating object loaded on the top plate, and a blower device provided in the main body and configured to blow air into the heating coil by introducing external air. The heating coil and the blower device are accommodated in the main body. The induction heating cooker according to the disclosure includes a first flow path for allowing air blown by the blowing device to be supplied toward the heating coil from an outer periphery side and a second flow path allowing air blown by the blowing device to be supplied toward the heating coil from a lower side.

With such a configuration, air is blown to the heating coil in two directions from the rear side and the lower side by the first blower and the second blower, so that the heating coil can be cooled efficiently. Therefore, high frequency current, which may cause the heating coil to generate relatively large heat, may be applied to the heating coil, so that high frequency or high current of current applied to the heating coil can be achieved, thereby providing the induction heating cooker with high output of power. In addition, since the heating coil is efficiently cooled, the blower device is reduced, so that the size of the induction heating cooker 1 can be reduced.

In the induction heating cooker according to the technology of the disclosure, the main body is provided with an exhaust port for discharging air passed through the heating. In this case, the exhaust port may be preferably positioned in the direction in which the blower device blows air to the first flow path.

With such a configuration, air is blown toward the exhaust port by the blower device, so that the air having a temperature elevated in the main body may be smoothly discharged out of the main body through the exhaust port while being suppressed from staying around the heating coil. Such a configuration is beneficial in efficiently cooling the heating coil.

In accordance with an aspect of the disclosure, the induction heating cooker to the technology is provided. The induction heating cooker to the technology includes a partition member that divides the space in the main body in the vertical direction. The partition member divides a first space constituting the first flow path and a second space constituting the second flow path. The blower device may blow air into the first space and the second space. In this case, the partition member may be preferably formed with a ventilation hole for allowing air blown by the blower device to flow from the second space, passing through the first space, to be supplied toward the heating coil from the lower side.

With such a configuration, since the air blown into the first space by the blower device is supplied to the heating coil from the outer periphery side, and the air blown into the second space is supplied to the heating coil from the lower side through the ventilation hole of the partition member, thereby easily implementing a configuration of blowing air to the heating coil in two directions by the blower device.

The partition member may be preferably provided with an edge wall surrounding at least a space in which the heating coil is disposed between the upper plate and the partition member in the first space.

With such a configuration, since a space in which the heating coil is disposed in the first space is surrounded by the edge wall of the partition member, air having a temperature elevated due to heat generation of the heating coil in the main body may be suppressed from leaking out to the surroundings, and the temperature elevated air may be efficiently discharged out of the main body through the exhaust port. Such a configuration is beneficial in efficiently dissipating heat of the induction heating cooker by preventing heat from staying in the main body.

The plurality of ventilation holes of the partition member are provided to be open toward a plurality of locations at intervals from each other in the circumferential direction of the heating coil.

With such a configuration, since the air blown to the second space by the blower device is supplied to a plurality of locations at intervals in the circumferential direction of the heating coil through the plurality of ventilation holes formed in the partition member, the heating coil may be cooled at the plurality of locations in the circumferential direction and thus can be efficiently cooled as a whole.

In the induction heating cooker provided with the partition member, the blower device may be disposed at one side in a horizontal direction with respect to the second space. In this case, the second space may be preferably provided with a splitting wall that divides air blown by the blower device into one side and the other side of an area corresponding to the heating coil in the vertical direction.

With such a configuration, air blown by the blower device is divided into one side and the other side of an area corresponding to the heating coil in the vertical direction by the splitting wall, so that a large amount of air is prevented from being circulated to a specific ventilation hole, and air is evenly discharged through a plurality of ventilation holes. Such a configuration is beneficial in efficiently cooling the heating coil as a whole.

In accordance with an aspect of the disclosure, the induction heating cooker with the partition member is provided. The induction heating cooker with the partition member includes a power supply circuit for supplying power to the heating coil. The first space may be an upper space partitioned by the partition member among the spaces within the main body, and the second space may be a space formed inside the partition member. In this case, the power supply circuit may be disposed in a lower space partitioned by the partition member among the spaces within the main body.

With such a configuration, the power supply circuit is separated from the heating coil by the partition member having the second space, so that heat generated by the heating coil is prevented from exerting an adverse effect on the power supply circuit. Accordingly, the reliability of the induction heating cooker may be increased.

In the induction heating cooker according to the technology of the disclosure, the amount of air flowing through the second flow path is preferably provided to be larger than the amount of air flowing through the first flow path.

With such a configuration, the blower device allows the heating coil to be supplied with air from a lower side thereof in an amount larger than that supplied from an outer periphery side thereof. Since the heating coil comes in contact with the air blown from the lower side of the heating coil in a larger area compared to the air blown from the outer periphery side, the efficiency of heat dissipation of the heating coil may be enhanced. Therefore, blowing a relatively large amount of air to the heating coil from the lower side contributes to increasing the cooling efficiency of the heating coil.

In the induction heating cooker according to the present disclosure, the blower device may preferably have a plurality of blowers which are disposed at different positions in the horizontal direction.

With such a configuration, the plurality of blower forming the blower device, which are disposed at different positions in the horizontal direction, may secure the total volume of air blown to the first flow path and the second flow path by the plurality of blowers while miniaturizing each blower. Such a configuration contributes to reducing the size of the induction heating cooker.

In accordance with an aspect of the disclosure, an induction heating cooker is provided. An induction heating cooker incudes a heating coil configured to heat a heating object, a first blower configured to blower air to the heating coil, a first flow path including a center flow path allowing the air from the first blower to be blown toward the heating coil in a first direction, and a second flow path provided to the air from the first blower to be blown toward the heating coil in a second direction 1 different from the first direction, and separated from the first flow path.

In accordance with an aspect of the disclosure, the induction heating cooker is provided. The induction heating cooker includes a circuit board disposed on a space separated from a space in which the heating coil is located, and a second blower configured to blow air toward the circuit board.

In accordance with an aspect of the disclosure, the first flow path includes a side flow path to allow the air from the second blower to be blown in a third direction different from the first direction and the second direction toward the heating coil.

The second blower may be arranged at a side in a horizontal direction with respect to the first blower.

The induction heating cooker may further include a substrate edge wall provided to surround the circuit board such that air having heat exchanged with the circuit board is guided to an outside.

In accordance with an aspect of the disclosure, the induction heating cooker may further include a third flow path is provided. The induction heating cooker includes to allow the air from the second blower to be guided toward one portion of the circuit board, and a fourth flow path provided to allow the air from the second blower to be guided to another portion of the circuit board, and separated from the third flow path.

The third flow path may be provided to guide air toward a side surface of the circuit board, and the fourth flow path may be provided to guide air toward an upper surface of the circuit board.

The induction heating cooker may further include a plurality of ventilation holes through which air passing through the second flow path is discharged to the heating coil, and the plurality of ventilation holes may be spaced apart from each other along a circumferential direction of the heating coil.

In accordance with an aspect of the disclosure, the second flow path may include a left side flow path is provided to guide the air from the first blower in one direction along the circumferential direction of the heating coil, and a right side flow path provided to guide the air from the first blower in a direction opposite to the one direction along the circumferential direction of the heating coil.

The second flow path may be formed to blow air in an amount larger than an amount in which the first flow path blows air.

The first flow path may be provided to guide air toward a side surface of the heating coil, and the second flow path may be provided to guide air toward a bottom surface of the heating coil.

The induction heating cooker may further include an exhaust port hole located to correspond to a direction in which the first blower blows air, and provided to discharge air passing through the heating coil to an outside.

The induction heating cooker may further include a coil edge wall provided to surround the heating coil to guide air having heat exchanged with the heating coil to an outside.

The induction heating cooker may further include an intake port through which air is introduced from an outside, and electronic parts including a switching mode power supply located on a flow path between the intake port and the first blower.

In accordance with another aspect of the disclosure, an induction heating cooker is provided. The induction heating cooker includes a heating coil configured to heat a heating object, a first blower configured to blow air to the heating coil, a second blower disposed at one side in a horizontal direction with respect to the first blower and configured to blow air to the heating coil, a center flow path configured to guide the air blown by the first blower toward one part of the heating coil, a side flow path configured to guide the air blown by the second blower toward another part of the heating coil, and a second flow path configured to guide the air blown by the first blower toward another part of the heating coil and formed to be separated from the first flow path.

The induction heating cooker may further include a circuit board disposed in a space separated from a space in which the heating coil is located, and provided to be cooled by the second blower.

The induction heating cooker may include a third flow path configured to guide the air blown by the second blower toward one part of the circuit board, and a third flow path configured to guide the air blown by the second blower to another part of the circuit board and formed to be separated from the third flow path.

The induction heating cooker may further include an exhaust port positioned to correspond to a direction in which the first blower and the second blower blow air, and configured to discharge the air passing through the heating coil and the circuit board to the outside.

The induction heating cooker may further include a substrate edge wall provided to surround the circuit board to guide the air having heat exchanged in the circuit board to the exhaust port, and a coil edge wall provided to surround the heating coil the heating coil to guide the air having heat exchanged in the heating coil to the exhaust port.

The induction heating cooker may further include a plurality of ventilation holes through which air passing through the second flow path is discharged to the heating coil, and the plurality of ventilation holes may be disposed to be spaced apart from each other along a circumferential direction of the heating coil.

According to the technique of the disclosure, by effectively cooling the heating coil, it is possible to increase the output of the induction heating cooker and contribute to reducing the size.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings of which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Hereinafter, embodiments will be described in detail with reference to the drawings. In the following embodiments, for the sake of convenience in description of an induction heating cooker, a front side in a direction opposing a user is referred to as "front" and a rear side in the direction is referred to as "back", and a left side when viewed from the front to the rear is "left" and a right side is referred to as "right", and an upper side in a height direction during use of the induction heating cooker is referred to as "upper" and a lower side is referred to as "lower".

Figure 1:
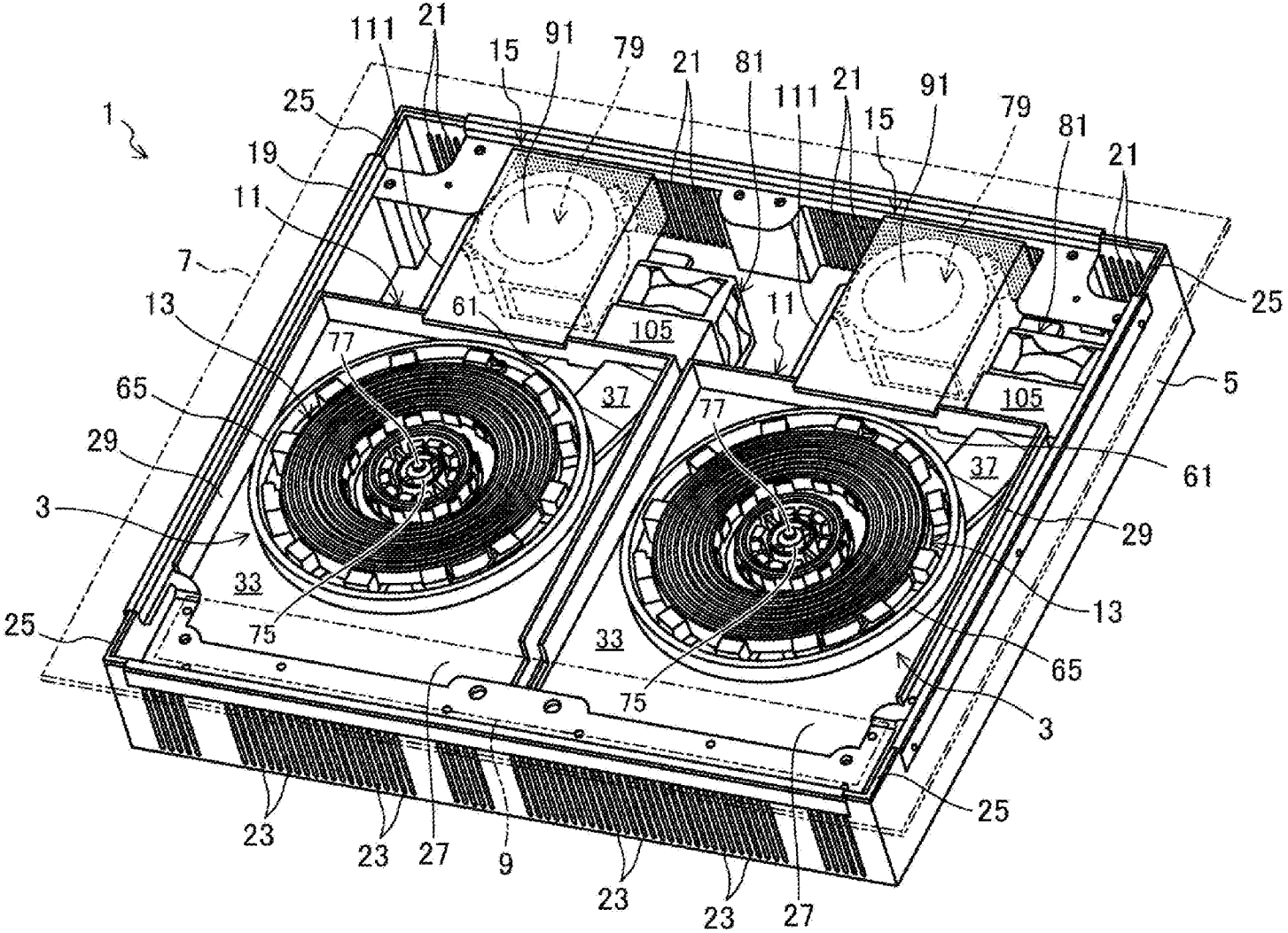
FIG. 1 is a perspective view illustrating an induction heating cooker according to an embodiment of the disclosure.
Figure 2:
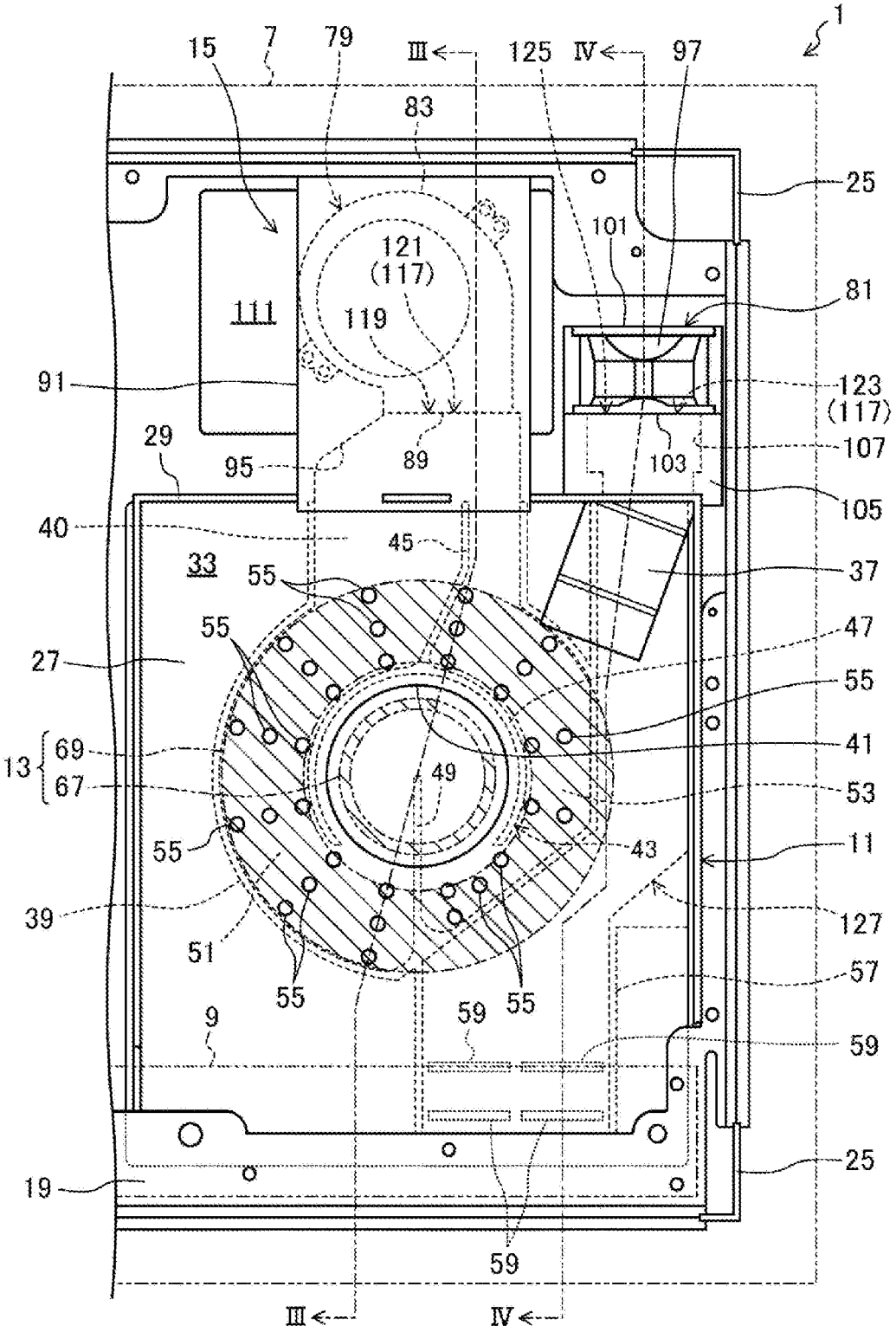
FIG. 2 is a plan view illustrating main parts of an induction heating cooker according to an embodiment of the disclosure.
Figure 3:
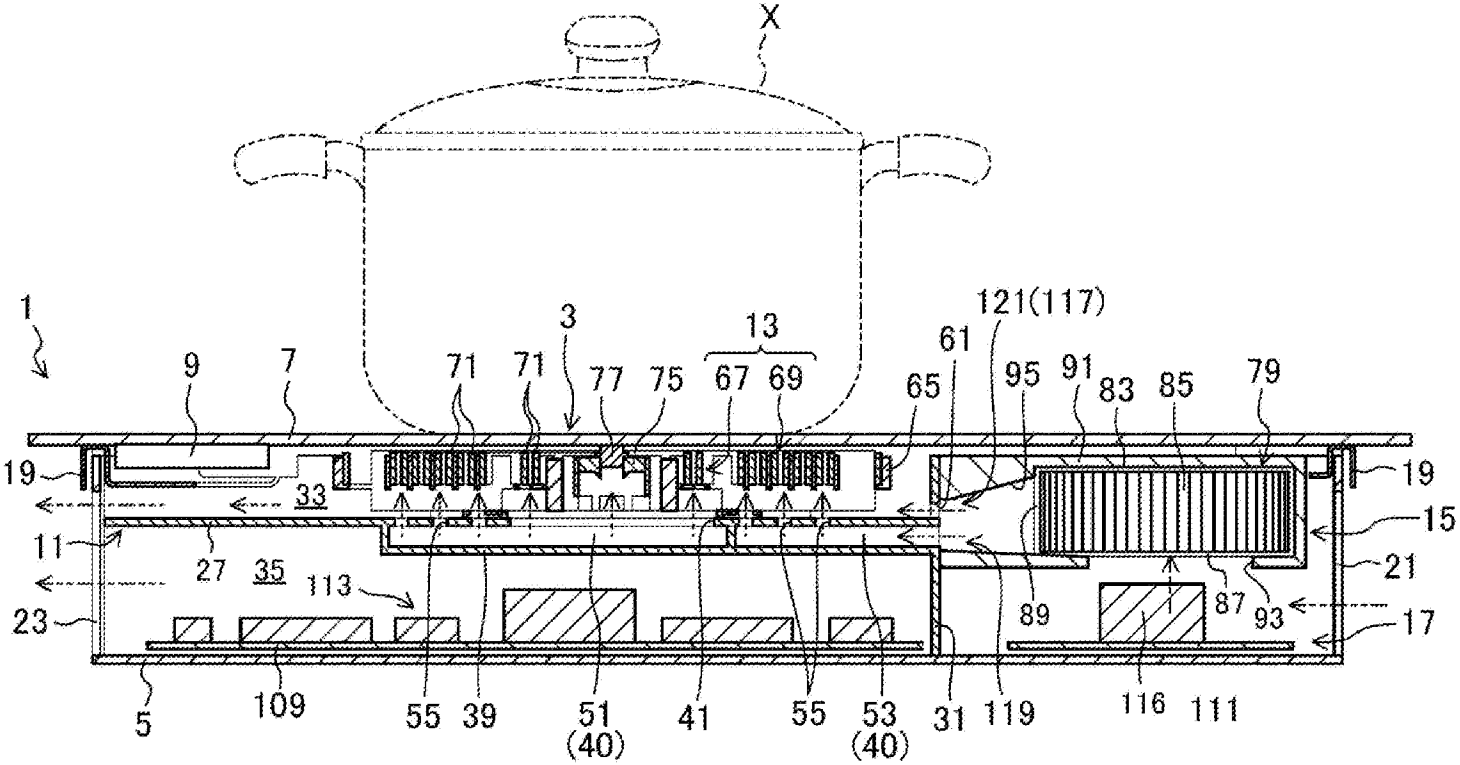
FIG. 3 is a cross-sectional view of the induction heating cooker taken along line III-III of FIG. 2 according to an embodiment of the disclosure.
Figure 4:
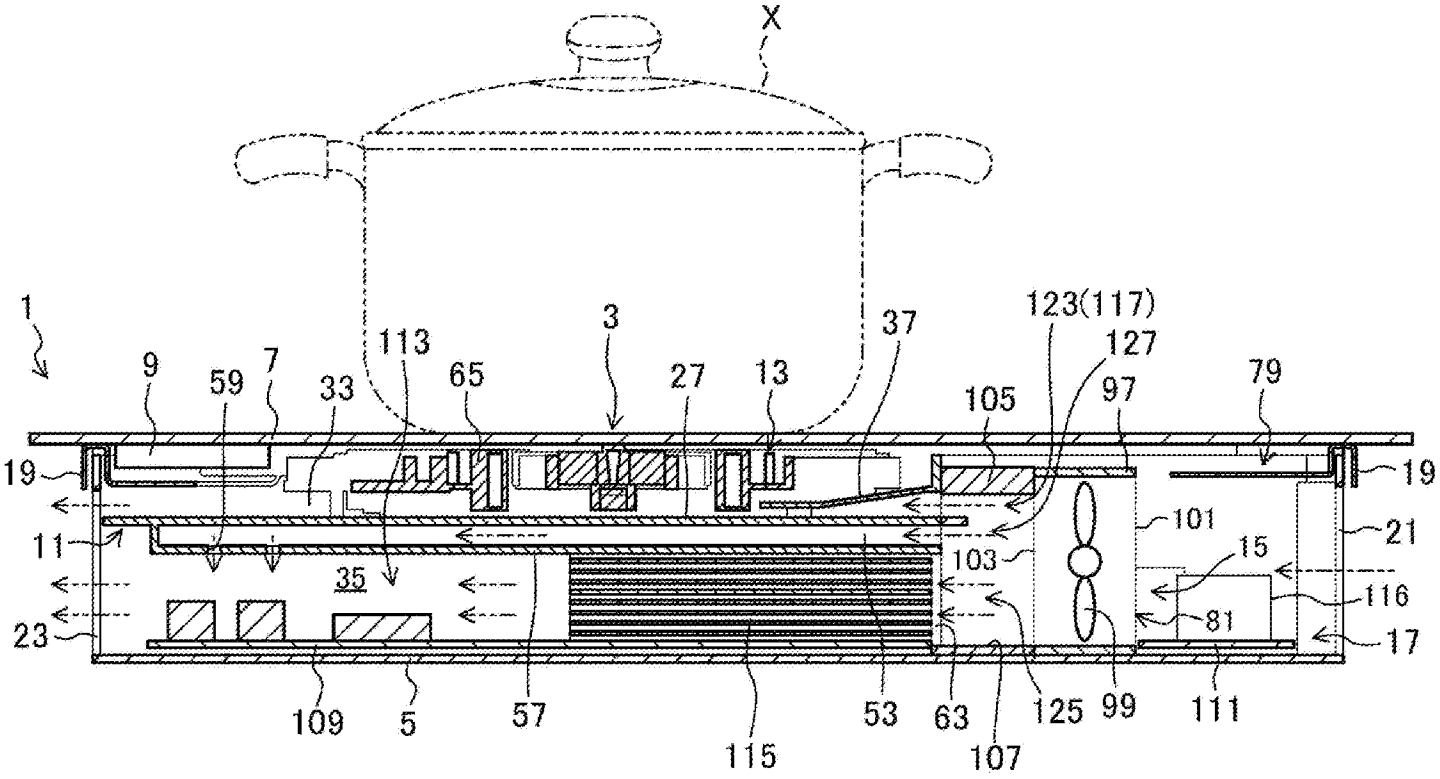
FIG. 4 is a cross-sectional view of the induction heating cooker taken along line IV-IV of FIG. 2 according to an embodiment of the disclosure.
Figure 5:
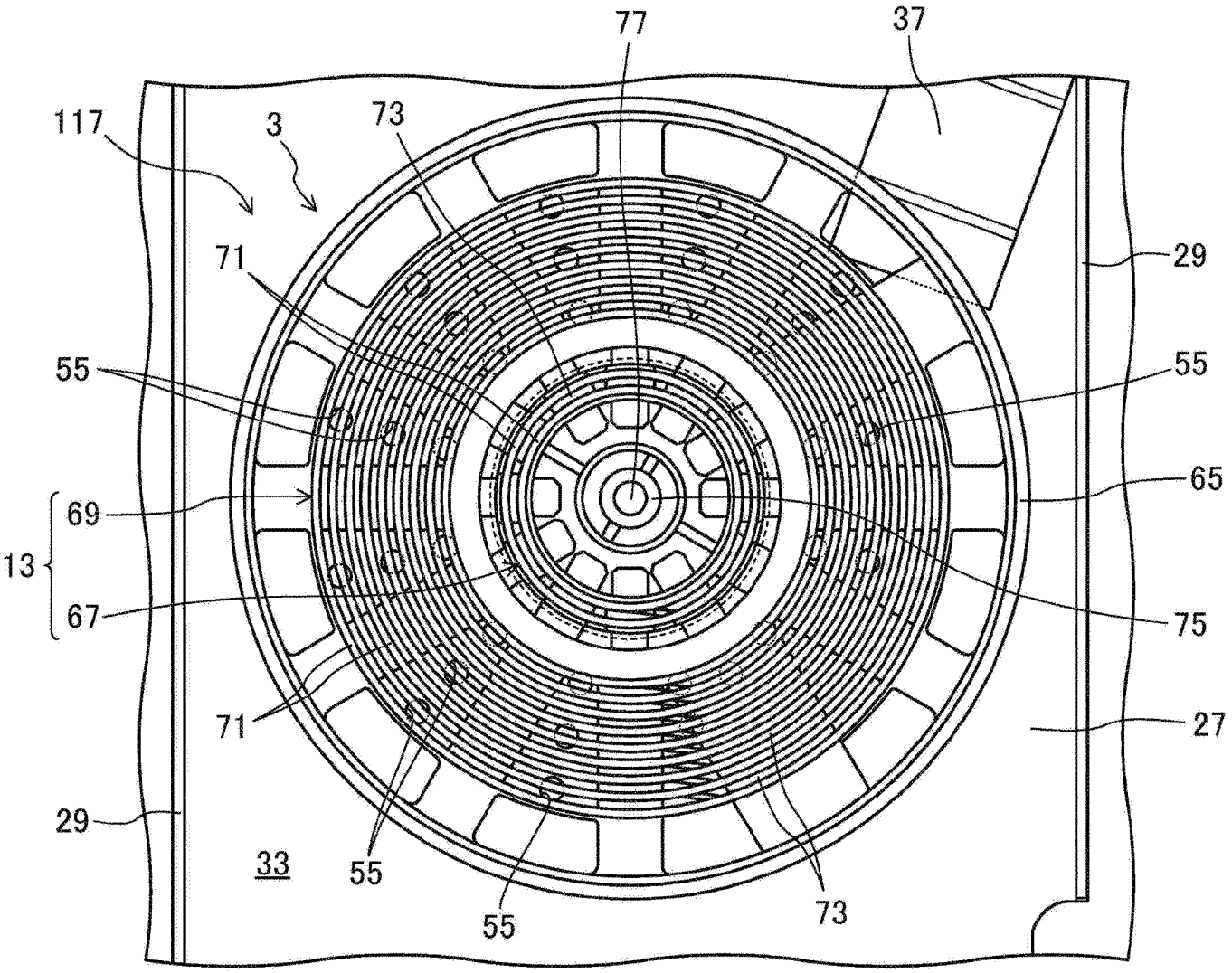
FIG. 5 is a plan view illustrating a portion of an induction heating cooker in which a heating coil is mounted according to an embodiment of the disclosure.

FIG. 1 is a perspective view illustrating an induction heating cooker according to an embodiment of the disclosure. FIG. 2 is a plan view illustrating main parts of an induction heating cooker according to an embodiment of the disclosure. FIG. 3 is a cross-sectional view of the induction heating cooker taken along line III-III of FIG. 2 according to an embodiment of the disclosure. FIG. 4 is a cross-sectional view of the induction heating cooker taken along line IV-IV of FIG. 2 according to an embodiment of the disclosure. FIG. 5 is a plan view illustrating a portion of an induction heating cooker in which a heating coil is mounted according to an embodiment of the disclosure. For the sake of convenience in description, in FIG. 1, a top plate 7 and a manipulation portion 9 are indicated by a double-dashed line. In addition, in FIG. 2, a heating coil 13 is schematically indicated by a double-dashed line and indicated by hatching.

An induction heating cooker 1 according to the embodiment is provided in a type of a built-in induction heating (IH) cooking heater that is mounted and assembled in an opening installed into a kitchen countertop, and configured to heat a heating object X, such as a frying pan or pot, using the principle of electromagnetic induction.

Referring to FIG. 1, the induction heating cooker 1 is provided in a double-burner type induction heating cooker with two heating portions 3 serving as a loading place for the heating object X on which induction heating is performable. The two heating portions 3 are provided at intervals in the left-right direction. The induction heating cooker is a double burner type induction heating cooker having two heating portions 3 capable of coping with all types of metal, and specifically, the two heating portions 3 are each configured to induction-heat not only magnetic stainless or steel, but also non-magnetic and low-resistance metal, such as aluminum and copper.

Referring to FIGS. 1 to 4, the induction heating cooker 1 includes a main body 5, a top plate 7, a manipulation portion 9, a cabinet 11, a heating coil 13, a blower device 15, and a control board 17. The cabinet 11, the heating coil 13, the blower device 15, and the control board 17 are provided with the same configuration for each of the heating portions 3, and are accommodated in the main body 5.

Main Body

The main body 5 has an outer edge corresponding to a space in which the induction heating cooker 1 is installed, and is formed in a substantially rectangular box shape that is open at an upper side thereof. The main body 5 is mainly formed of sheet metal or the like. A frame-shaped bracket 19 formed of sheet metal or the like is assembled to a rim around the opening of the main body 5. A plurality of intake ports 21 are formed in a rear wall of the main body 5. A plurality of exhaust ports 23 are formed in a front wall of the main body 5. The intake ports 21 and the exhaust ports 23 are slit-shaped openings extending in the vertical direction, and are formed at intervals in the left and right directions in each of the rear wall and the front wall of the main body 5.

Top Plate

The top plate 7 is provided on an upper part of the main body 5 through the bracket 19 and covers the opening of the main body 5. A gap between a portion exposed from the bracket 19 at four corners of the main body 5 and the top plate 7 is sealed with a seal member 25 formed of polyurethane or the like. The top plate 7 is a substantially rectangular plate body formed of glass or ceramic having high heat resistance, and constitutes a loading surface on which a heating object X is placed. Position marks (not shown) representing the positions of the respective heating portions 3 are indicated on the loading surface.

Manipulation Portion

The manipulation portion 9 is provided in a panel shape and located between the bracket 19 and the top plate 7 at a front side area of the main body 5. Although not shown, the manipulation portion 9 has a left manipulation portion and a right manipulation portion. The left manipulation portion displays a heating level for the heating object X loaded on the heating portion 3 on the left side while receiving an input. The right manipulation portion displays a heating level for the heating object X loaded on the heating portion 3 on the right side while receiving an input. Such a left manipulation portion and a right manipulation portion may each include, for example, a display provided as a liquid crystal display device and a touch panel.

Cabinet

The cabinet 11 is provided on both left and right sides of the front side area of the main body 5. The cabinet 11 is an example of a partition member. The cabinet 11 has a partition plate portion 27, a coil edge wall 29, and a substrate edge wall 31. The partition plate portion 27 partitions the interior of the main body 5 in the vertical direction. In this way, the space in the main body 5 is divided into an upper space 33 positioned above the partition plate portion 27 and a lower space 35 positioned below the partition plate portion 27. The upper space 33 corresponds to a first space.

The partition plate portion 27 is provided at a rear right side thereof with a first duct 37 that extends to the left side toward the front. The first duct 37 has a rear end that is open to the rear of the cabinet 11, and has a front end that is open to the front at the upper side of the partition plate portion 27. The partition plate portion 27 is provided at a center portion and a rear side thereof with a second duct 39 in which a region corresponding to the heating coil 13 is extended substantially as a whole. The second duct 39 is formed in a bulge at a lower side of the partition plate portion 27.

The second duct 39 has a rear end that is open to the rear of the cabinet 11. The partition plate portion 27 is provided in the central portion thereof with a first ventilation hole 41 having a large diameter. The first ventilation hole 41 communicates a space 40 in the second duct 39 with the upper space 33. The shape of the first ventilation hole 41 is, for example, a circular shape. The space 40 in the second duct 39 is partitioned from the upper space 33 by the cabinet 11 (the partition plate portion 27). The space 40 corresponds to a second space.

The second duct 39 is provided therein with a splitting wall 43 that divides a flow path from the rear end opening to the first ventilation hole 41 into two parts. The splitting wall 43 has a separation wall 45, a bypass wall 47, and a lead-out wall 49.

The separation wall 45 extends in a forward direction from the rear end opening of the second duct 39 toward the first ventilation hole 41. The splitting wall 43 divides air blown inward from the rear end opening of the second duct 39 into the right side and left sides. The bypass wall 47 extends in an arc shape surrounding the first ventilation hole 41 except for a part of the front side of the first ventilation hole 41 when viewed from above. The bypass wall 47 is connected to the separation wall 45 and allows the air separated by the separation wall 45 to pass around the first ventilation hole 41 and flow forward.

The lead-out wall 49 extends from an outer peripheral wall of the second duct 39 at a front of the first ventilation hole 41, passing through open ends of the front side of the bypass wall 47, to a position corresponding to the inside of the first ventilation hole 41. The lead-out wall 49 allows the air passed around the first ventilation hole 41 by the bypass wall 47 to flow through the first ventilation hole 41 in a separated state. The space 40 in the second duct 39 includes a left flow path 51 and a right flow path 53 bypassing on the left side of the first ventilation hole 41 and bypassing on the right side of the first ventilation hole 41, respectively.

Portions of the partition plate portion 27 corresponding to the left flow path 51 and the right flow path 53 around the first ventilation hole 41, that is, the upper wall of the second duct 39, are formed with a plurality of second ventilation holes 55. The plurality of second ventilation holes 55 are spaced apart from each other in the circumferential direction around the first ventilation hole 41, and are provided to form a radial shape centered on the first ventilation hole 41. Similar to the first ventilation hole 41, the second ventilation hole 55 is a hole that communicates the space 40 (the left flow path 51 or the right flow path 53) in the second duct 39 with the upper space 33. The shape of the second ventilation hole 55 is, for example, a circular shape having a diameter smaller than that of the first ventilation hole 41.

A third duct 57 extending in the front-rear direction is provided on the right side of the partition plate portion 27. The third duct 57 is formed in a bulge at a lower side of the partition plate portion 27 while extending from a position overlapping the first duct 37 via the right side of the second duct 39 to a position near the rear end of the partition plate portion 27 when viewed from above. The third duct 57 has a rear end located below the rear end opening of the first duct 37 and open to the rear of the cabinet 11. A plurality of third ventilation holes 59 are formed in a lower wall of a front side area of the third duct 57. The third ventilation hole 59 is a hole for communicating the interior of the third duct 57 with the lower space 35. The shape of the third ventilation hole 59 is, for example, a slit shape extending in the left-right direction.

The coil edge wall 29 is integrally formed with the partition plate portion 27. The col edge wall 29 is provided on the outer periphery of the partition plate portion 27 and extends upward from the partition plate portion 27. The coil edge wall 29 surrounds the upper space 33 between the top plate 7 and the coil edge wall 29 in three directions corresponding to both left and right sides and the rear side, and allows the upper space 33 to be open to the front in which the exhaust port 23 is provided. The coil edge wall 29 has a rear side wall, a lower portion of which is formed with an upper vent 61 open rearward. The upper vent 61 is located above the rear end opening of the second duct 39.

The substrate edge wall 31 is integrally formed with the partition plate portion 27. The substrate edge wall 31 is provided on the outer periphery of the partition plate portion 27 and extends downward from the partition plate portion 27. The substrate edge wall 31 surrounds the lower space 35 in three directions corresponding to both left and right sides and the rear side, and allows the lower space 35 to be open to the front in which the exhaust port 23 is provided. The substrate edge wall 31 has a rear side wall, a right portion of which is formed with a lower vent 63 that is open rearward. The lower vent 63 is located below the rear end opening of the third duct 57.

Heating Coil

Referring to FIG. 5, the heating coil 13 is supported by a coil base 65 on the partition plate portion 27 of the cabinet 11 and disposed in the upper space 33. The coil base 65 is formed in an approximately disk shape. Ferrite is substantially radially buried in the coil base 65. The heating coil 13 is a horizontal dual coil for induction-heating the heating object X loaded on the top plate 7, and includes an inner coil 67 and an outer coil 69 provided on the same plane in a concentric circle. The inner coil 67 is disposed inside the outer coil 69 and is electrically connected to the outer coil 69.

The inner coil 67 and the outer coil 69 are each formed by winding a coil wire 71, referred to as a Ritz wire or a flat wire a plurality of turns. Between the coil wires 71 adjacent to each other in each of the inner coil 67 and the outer coil 69, a gap through which air may flow is provided. The inner coil 67 is disposed on the first ventilation hole 41 of the cabinet 11. The plurality of second ventilation holes 55 provided in the cabinet 11 at a plurality of locations spaced apart from each other in the circumferential direction of the outer coil 69 are oriented toward the opening. The gap 73 between the coil wires 71 in the outer coil 69 is provided at a position corresponding to the second ventilation hole 55.

A sensor support 75 is provided at the center of the coil base 65. A temperature sensor 77 is mounted on the sensor support 75. As the temperature sensor 77, a contact-type temperature sensor, such as a thermistor, may be used. The temperature sensor 77 is provided in close contact with a lower surface of the top plate 7, and senses the temperature of the heating object X loaded on the heating portion 3 over the top plate 7. The temperature sensor 77 may be a non-contact type temperature sensor, such as an infrared sensor. The detected value of the temperature sensor 77 is transmitted to the control board 17.

Blower Device

The blower device 15 allows external air to be introduced into the main body 5 from the intake port 21, generates a flow of air flowing from the intake port 21, passing through the heating coil 13 and the control board 17, and directed to the exhaust port 23 in the main body 5, and discharges the air in the main body 5 to the outside from the exhaust port 23. The blower device 15 has a first blower 79 and a second blower 81. The first blower 79 and the second blower 81 are disposed at different positions in the horizontal direction.

The first blower 79 is disposed behind the central portion of the cabinet 11 in the left-right direction. The first blower 79 has a casing 83 and an electric fan 85 accommodated in the casing 83. The first blower 79 may be provided using a centrifugal blower that has a blower fan (referred to as a sirocco fan) as the electric fan 85. The first blower 79 is provided in a posture with the rotation axis of the electric fan 85 oriented in the vertical direction. The first blower 79 allows air to be introduced from an inlet 87 provided in a lower portion of the casing 83 by the rotating operation of the electric fan 85, and allows the air to be blown from an outlet 89 of the casing 83 facing forward.

The first blower 79 is accommodated in a case 91. An opening 93 exposing the air inlet 87 of the first blower 79 is formed on a lower surface of the case 91. A discharge flow path 95 through which air blown by the first blower 79 circulates is formed in a front side area of the case 91. The discharge flow path 95 has a front end that is open toward the front of the case 91. The opening of the front end of the discharge flow path 95 is connected to the rear end opening of the second duct 39 and the upper vent 61 as a front end of the case 91 is adjacent to the rear wall of the cabinet 11. In the direction in which the first blower 79 blows air from the upper vent 61 to the upper space 33 through the discharge flow path 95, the exhaust port 23 is positioned.

The second blower 81 is disposed on the right side of the first blower 79 behind the cabinet 11. The second blower 81 has a casing 97 and an electric fan 99 accommodated in the casing 97. For the second blower 81, an axial blower having a propeller fan may be used as the electric fan 99. The second blower 81 is provided in a posture with the rotation axis of the electric fan 99 oriented in the front-rear direction. The second blower 81 allows air to be introduced from an inlet 101 provided at a rear side of the casing 97 by the rotational operation of the electric fan 99, and allows the air to be blown from an outlet 103 provided at a front side of the casing 97.

A flow path member 105 having a block shape is provided between the second blower 81 and the rear wall of the cabinet 11. The flow path member 105 is provided with a flow path connecting passage 107 opening in a direction in which air is blown from the outlet 103. A rear end opening of the flow path connection passage 107 is connected to the outlet 103 of the second blower 81. A front end opening of the flow path connection passage 107 is connected to the rear end opening of the first duct 37, the rear end opening of the third duct 57, and the lower vent 63 as a front end of the flow path member 105 is adjacent to the rear wall of the cabinet 11. In the directions in which the second blower 81 blows air from the first duct 37 to the upper space 33 and blows air from the lower vent 63 to the upper space 33 through the flow path connection passage 107, the exhaust ports 23 are located.

Control Board

The control board 17 controls the heating operation of the heating coil 13 and the blowing operation of the first blower 79 and the second blower 81. The control board 17 has a first circuit board 109 and a second circuit board 111.

The first circuit board 109 is disposed in the lower space 35 below the cabinet 11. On the first circuit board 109, an inverter circuit 113, other electronic components, a heat sink 115, and the like are mounted as a power supply circuit. The first circuit board 109 applies a high frequency current of about 20 kHz to 100 kHz to the heating coil 13. The magnitude of the high-frequency current applied to the heating coil 13 is controlled by the first circuit board 109 based on the detection value of the temperature sensor 77 or the like according to the heating level set by the manipulation portion 9.

The second circuit board 111 is disposed behind the cabinet 11. Electronic components 116, such as a switching mode power supply, are mounted on the second circuit board 111. The second circuit board 111 supplies power to the first blower 79 and the second blower 81, and drives the first blower 79 and the second blower 81. The amount of air blown by the blower device 15, that is, the number of rotations of the fan of the first blower 79 and the number of rotations of the fan of the second blower 81 are controlled by the second circuit board 111.

Flow Path in Main Body

The main body 5 is provided therein with a first flow path 117 and a second flow path 119 serving as flow paths through which air for cooling the heating coil 13 flows by the operation of the blower device 15.

The first flow path 117 is a flow path that allows air blown by the blower device 15 toward the heating coil 13 to be supplied from an outer peripheral side. The first flow path 117 has a center flow path 121 and a side flow path 123.

The center flow path 121 is formed by the discharge flow path 95 of the case 91 accommodating the first blower 79, the upper vent 61 of the cabinet 11, and the upper space 33 above the partition plate portion 27 in the main body 5. The center flow path 121 supplies the air blown by the first blower 79 to the heating coil 13 from an immediately rear side of the heating coil 13.

The side flow path 123 is formed by the flow path connecting passage 107 of the flow path member 105, a space in the first duct 37 of the cabinet 11, and the upper space 33 on the partition plate portion 27 in the main body 5. The side flow path 123 supplies the air blown by the second blower 81 to the heating coil 13 from an immediate rear side of the heating coil 13.

The second flow path 119 is a flow path that allows air blown by the first blower 79 to be supplied toward the heating coil 13 from the lower side of the heating coil 13. The second flow path 119 is formed by the discharge flow path 95 of the case 91 accommodating the first blower 79, the left flow path 51 and the right flow path 53 in the second duct 39 of the cabinet 11, and the first ventilation hole 41 and the plurality of second ventilation holes 55 of the partition plate portion 27.

In the main body 5, a third flow path 125 and a fourth flow path 127 are provided as flow paths through which air for cooling the first circuit board 109 flows.

The third flow path 125 is a flow path that allows air blown by the second blower 81 to be supplied toward the first circuit board 109 from the outer periphery side. The third flow path 125 is formed by the flow path connecting passage 107 of the flow path member 105, the lower vent 63 of the cabinet 11, and the lower space 35 below the partition plate portion 27 in the body 5.

The fourth flow path 127 is a flow path that allows air blown by the second blower 81 to be supplied toward the first circuit board 109 from the upper side. The fourth flow path 127 is formed by the flow path connecting passage 107 of the flow path member 105, a space in the third duct 57 of the cabinet 11, and the plurality of third ventilation holes 59 provided on the front portion of the third duct 57.

In the induction heating cooker 1 of the above configuration, when the first blower 79 and the second blower 81 are driven, external air is introduced into the main body 5 from the intake port 21 and the air, introduced into the main body 5, passes through the second circuit board 111, and then is blown to the center flow path 121 and the second flow path 119 by the first blower 79, and then blown to the side flow path 123, the third flow path 125, and the fourth flow path 127 by the second blower 81.

In this case, the air volume circulating through the second flow path 119 is larger than the air volume circulating through the first flow path 117. Here, the air volume circulating through the first flow path 117 is an average value of the air volume circulating through the center flow path 121 and the air volume circulating through the side flow path 123. The air volume circulating through the first flow path 117 may be one of the air volume circulating through the center flow path 121 and the air volume circulating through the side flow path 123 (for example, a larger air volume). In addition, the air volume circulating through the second flow path 119 is the air volume passing through the rear end opening of the second duct 39. The air volume circulating through the second flow path 119 may be one of the air volume circulating through the left flow path 51 and the air volume circulating through the right flow path 53, and may be an average value of the air volume circulating through the left flow path 51 and the air volume circulating through the right flow path 53.

The air blown into the center flow path 121 by the first blower 79 is supplied from the rear side of the heating coil 13, and the air after passing through the heating coil 13 is directed toward the exhaust port 23 and discharged out of the main body 5 from the exhaust port 23. The air blown into the second flow path 119 by the first blower 79 and discharged from the first ventilation hole 41 and the second ventilation hole 55 on the lower side of the heating coil 13 is supplied to the heating coil 13, and while joining the air supplied from the first flow path 117 (the center flow path 121 and the side flow path 123) passes through the heating coil 13 and then is directed toward the exhaust port 23 to be discharged out of the main body 5 from the exhaust port 23.

The air blown to the side flow path 123 by the second blower 81 is supplied from the right rear side of the heating coil 13, and while joining the air supplied from the center flow path 121, passes through the heating coil 13 and then is directed toward the exhaust port 23 to be discharged out of the main body 5 from the exhaust port 23. The air blown to the third flow path 125 by the second blower 81 is supplied from the rear side of the first circuit board 109, and the air, passing through the first circuit board 109, is directed toward the exhaust port 23 to be discharged out of the main body 5 from the exhaust port 23. The air blown to the fourth flow path 127 by the second blower 81 is supplied to the front portion of the first circuit board 109 from the upper side of the first circuit board 109, and while joining the air blown to the third flow path 125, the air is directed to the exhaust port to be discharged out of the main body 5 from the exhaust port 23.

In this way, the flow of air generated in the main body 5 by the driving of the first blower 79 and the second blower 81 cools the heating coil 13, the first circuit board 109, and the second circuit board 111. The second circuit board 111 is cooled by being exposed to air directed from the intake port 21 to the first blower 79 and the second blower 81. The first circuit board 109 is cooled by being exposed to air supplied from the rear side thereof through the third flow path 125 and air supplied from the upper side thereof through the fourth flow path 127. The heating coil 13 is cooled by being exposed to air supplied from the rear side thereof through the first flow path 117 and air supplied from the lower side thereof through the second flow path 119.

Effect of Example

With the induction heating cooker 1 according to the embodiment, air is blown to the heating coil 13 in two directions from the rear side and the lower side by the first blower 79 and the second blower 81, so that the heating coil 13 can be cooled efficiently. Therefore, high frequency current, which may cause the heating coil 13 to generate relatively large heat, may be applied to the heating coil 13, so that high frequency or high current of current applied to the heating coil can be achieved, thereby providing the induction heating cooker 1 with high output of power. In addition, since the heating coil 13 is efficiently cooled, the size of the first blower 79 and the second blower 81 is reduced, so that the size of the induction heating cooker 1 can be reduced.

With the induction heating cooker 1 according to the embodiment, the exhaust ports 23 are located in a direction in which the first blower 79 blows air to the center flow path 121 and in a direction the second blower 81 blows air to the side flow path 123, and air is blown toward the exhaust ports 23 by the first blower 79 and the second blower 81, so that the air having a temperature elevated in the main body 5 can be smoothly discharged out of the main body 5 through the exhaust port 23 while being suppressed from staying around the heating coil 13. Such a configuration is beneficial in efficiently cooling the heating coil 13.

With the induction heating cooker 1 according to the embodiment, since the upper space 33 in which the heating coil 13 is disposed is surrounded by the coil edge wall 29 of the cabinet 11, air having a temperature elevated due to heat generation of the heating coil 13 may be suppressed from leaking out to the surroundings, and the temperature elevated air may be efficiently discharged out of the main body 5 through the exhaust port 23. Such a configuration is beneficial in efficiently dissipating heat of the induction heating cooker 1 by preventing heat from staying in the main body 5.

With the induction heating cooker 1 according to the embodiment, since the lower space 35 in which the first circuit board 109 is disposed is surrounded by the substrate edge wall 31 of the cabinet 11, the air having a temperature elevated due to heat generation of the first circuit board 109 in the main body 5 can be suppressed from leaking to the surroundings, and efficiently discharged out of the main body 5 through the exhaust port 23. Such a configuration is also beneficial in efficiently dissipating the heat of the induction heating cooker 1.

With the induction heating cooker 1 according to the embodiment, since the air blown to the second duct 39 by the first blower 79 is supplied to a plurality of locations at intervals in the circumferential direction of the heating coil 13 through the first ventilation hole 41 and the second ventilation holes 55 provided in the partition plate portion 27, the heating coil 13 is cooled at the plurality of locations in the circumferential direction and thus can be efficiently cooled as a whole.

With the induction heating cooker 1 according to the embodiment, the air blown into the second duct 39 by the first blower 79 is divided between the left flow path 51 and the right flow path 53 by the splitting wall 43, so that a large amount of air is prevented from being circulated to the first ventilation hole 41 or a specific second ventilation hole 55, and air is evenly discharged not only from the first ventilation hole 41 but also each second ventilation hole 55. Such a configuration is beneficial in efficiently cooling the heating coil 13 as a whole.

With the induction heating cooker 1 according to the embodiment, the first circuit board 109 is separated from the heating coil 13 by the cabinet 11 including the second flow path 119 (the left flow path 51 and the right flow path 53) and the third flow path 125, so that heat generated by the heating coil 13 is prevented from exerting an adverse effect on the inverter circuit 113 or the like. Accordingly, the reliability of the induction heating cooker 1 can be increased.

With the induction heating cooker 1 according to the embodiment, the blower device 15 allows the heating coil 13 to be supplied with air from a lower side thereof in an amount larger than that supplied from an outer periphery side thereof. Since the heating coil 13 comes in contact with the air blown from the lower side of the heating coil 13 in a larger area compared to the air blown from the outer periphery side, the efficiency of heat dissipation of the heating coil 13 may be enhanced. Therefore, blowing a relatively large amount of air to the heating coil 13 from the lower side contributes to increasing the cooling efficiency of the heating coil 13.

With the induction heating cooker 1 according to the embodiment, the blower device 15 has the first blower 79 and the second blower 81, and the first blower 79 and the second blower 81, which are disposed at different positions in the horizontal direction, secure the total volume of air blown to the first flow path 117 and the second flow path 119 by the first blower 79 and the second blower 81 while miniaturizing the first blower 79 and the second blower 81. Such a configuration contributes to reducing the size of the induction heating cooker 1.

In the above, a preferred embodiment has been described as an example of the present disclosure. However, the features of the present disclosure are not limited thereto, and may be applied to various forms in which appropriate changes, substitutions, additions, omissions, and the like are implemented. In addition, some of the components described in the accompanying drawings and detailed description may also include components that are not needed. Therefore, even when such constituent elements are described in the accompanying drawings and detailed description, such constituent elements may not be recognized as needed.

For example, the following configuration is also possible for the above embodiment.

In the above embodiment, the intake port 21 is formed in the rear wall of the main body 5, the exhaust port 23 is formed in the front wall of the main body 5, and the blower device 15 generates a flow of air directed from the intake port 21 on the rear side toward the exhaust port 23 on the front side in the main body 5, but the disclosure is not limited thereto. For example, the intake port 21 and the exhaust port 23 may be respectively formed on the left side and the right side in the rear wall of the main body 5. In this case, the blower device 15 may be provided to generate a flow of air from the intake port 21 flowing through the heating coil 13 and the control board 17 and then making a U-turn, flowing toward the exhaust port 23.

In the above embodiment, the volume of air circulating through the second flow path 119 is provided to be larger than that circulating through the first flow path 117, but the disclosure is not limited thereto. The volume of air circulating through the second flow path 119 and the volume of air circulating through the first flow path 117 may be similar to each other. The volume of air flowing through the second flow path 119 may be smaller than the volume of air flowing through the first flow path 117.

In the above embodiment, the induction heating cooker 1 is illustrated as having a flow path in which air is blown toward the heating coil 13 from the rear side and the lower side in the main body 5 by the blower device 15, but the disclosure is not limited thereto. For example, the flow path of the main body 5 in which the blower device 15 blows air may be configured to blow air toward the heating coil 13 from one of the left and right sides, and the lower side of the heating coil 13. The flow path of the main body 5 may be variously provided as long as it has a flow path allowing air blown by the blower device 15 to be supplied toward the heating coil 13 from the outer periphery side and a flow path allowing air blown by the blower device 15 to be supplied toward the heating coil 13 from the lower side, in the main body 5.

In the above embodiment, the blower device 15 is illustrated as having the first blower 79 and the second blower 81, but the disclosure is not limited thereto, and the blower device 15 may include only one blower or three or more blowers.

In the above embodiment, the first blower 79 is illustrated as blowing air to the first flow path 117 and the second flow path 119, and the second blower 81 is illustrated as blowing to the first flow path 117, the third flow path 125, and the fourth flow path 127, but the disclosure is not limited thereto. For example, the first blower 79 may blow air only to the first flow path 117, the second blower 81 may blow air only to the second flow path 119, and a separate blower (a third blower) may blow air to the third flow path 125 and the fourth flow path 127.

In the above embodiment, a centrifugal blower is illustrated as the first blower 79 and an axial blower is illustrated as the second blower 81, but the disclosure is not limited thereto. As the first blower 79, an axial flow blower, a mixed flow blower, or a cross-flow blower may be used. In addition, as the second blower 81, a centrifugal fan, a mixed flow fan, or a cross-flow fan may be used.

In the above embodiment, the induction heating cooker 1 is illustrated as a double-burner type induction heating cooker having two heating portions 3 each capable of coping with all types of metals, but the disclosure is not limited thereto. For example, in the induction heating cooker 1, only one of the two heating portions 3 may be provided as a single all-metal available type heating portion, that is, a type capable of coping with all metals, or both of the two heating portions 3 may be provided as a magnetic exclusive type for magnetic materials, such as stainless steel or iron having magnetic properties. In addition, the induction heating cooker 1 may have one heating portion 3 or three or more heating portions 3.

In the above embodiment, the induction heating cooker 1 is illustrated as a built-in type induction heating cooker, but the disclosure is not limited thereto. The built-in induction heating cooker 1 is only an example, and the technology of the disclosure may also be applied to a mounting type induction heating cooker installed on a kitchen countertop.

As described above, the technique of the disclosure is useful for an induction heating cooker that may cool the heating coil by blowing air.

While the disclosure has been shown described with reference to various embodiments thereof, it will be understood by those skilled in the art that various changes in form and details may be made therein without departing from the spirit and scope of the disclosure as defined by the appended claims and their equivalents.

What is claimed is:

1. An induction heating cooker comprising:

a main body;

a top plate provided on an upper portion of the main body creating an interior space of the main body;

a partition plate portion dividing the interior space of the main body into an upper space and a lower space;

a heating coil disposed in the upper space and configured to heat a heating object positioned on the top plate;

a circuit board disposed in the lower space separated from the upper space in which the heating coil is located;

a first blower configured to blow air above the partition plate portion through the upper space along a first flow path, parallel to the top plate, and in a first direction across an entire lower surface of the heating coil and to blow the air through the upper space along a second flow path toward the heating coil in a second direction;

a second blower configured to blow the air through the lower space below the partition plate portion underneath the heating coil toward the circuit board; and at least one duct configured to guide the air from the second blower below the partition plate portion through the lower space along a third flow path provided to allow the air to be guided toward a side surface of the circuit board for cooling the circuit board, and separated from the first flow path and the second flow path, and to guide the air below the partition plate portion through the lower space along a fourth flow path provided to allow the air to be guided toward an upper surface of the circuit board for cooling the circuit board, and separated from the first flow path, the second flow path, and the third flow path.

2. The induction heating cooker of claim 1, wherein the first flow path further includes a side flow path to allow the air from the second blower to be blown in a third direction different from the first direction and the second direction toward the heating coil.

3. The induction heating cooker of claim 1, wherein the second blower is arranged at a side in a horizontal direction with respect to the first blower.

4. The induction heating cooker of claim 1, further comprising:

a substrate edge wall provided to surround the circuit board such that the air having heat exchanged with the circuit board is guided to an outside.

5. The induction heating cooker of claim 1, further comprising:

a plurality of ventilation holes in the partition plate portion through which the air passing through the second flow path is discharged to the heating coil, wherein the plurality of ventilation holes are spaced apart from each other along a circumferential direction of the heating coil.

6. The induction heating cooker of claim 1, wherein the second flow path includes:

a left side flow path provided to guide the air from the first blower in one direction along a circumferential direction of the heating coil; and a right side flow path provided to guide the air from the first blower in a direction opposite to the one direction along the circumferential direction of the heating coil.

7. The induction heating cooker of claim 1, wherein the second flow path is formed to blow the air in an amount larger than an amount in which the first flow path blows the air.

8. The induction heating cooker of claim 1, wherein the first flow path is provided to guide the air toward a side surface of the heating coil, and wherein the second flow path is provided to guide the air toward a bottom surface of the heating coil.

9. The induction heating cooker of claim 1, further comprising:

an exhaust port located to correspond to a direction in which the first blower blows the air, and provided to discharge the air passing through the heating coil to an outside.

10. The induction heating cooker of claim 9, further comprising:

a coil edge wall provided to surround the heating coil to guide the air having heat exchanged with the heating coil to the exhaust port.

11. The induction heating cooker of claim 1, further comprising:

an intake port through which the air is introduced from an outside; and one or more electronic parts including a switching mode power supply located on a flow path between the intake port and the first blower.

12. The induction heating cooker of claim 11, further comprising:

a control board; and an exhaust port located to correspond to a direction in which the first blower blows the air, and provided to discharge the air passing through the heating coil to an outside.

13. The induction heating cooker of claim 12, wherein the intake port is in communication with the first blower.

14. The induction heating cooker of claim 13, wherein the first blower generates air flow from the intake port, passing through the heating coil and the control board, to the exhaust port.

* * * * *